US011612260B1

(12) United States Patent
Bak

(10) Patent No.: US 11,612,260 B1
(45) Date of Patent: Mar. 28, 2023

(54) MODULAR BOWL HOLDER

(71) Applicant: B2B International Pty Ltd, St Leonards (AU)

(72) Inventor: Joshua Jisoo Bak, Killara (AU)

( * ) Notice: Subject to any disclaimer, the term of this patent is extended or adjusted under 35 U.S.C. 154(b) by 0 days.

(21) Appl. No.: 17/542,558

(22) Filed: Dec. 6, 2021

(51) Int. Cl.
*A47G 23/06* (2006.01)

(52) U.S. Cl.
CPC ..... *A47G 23/0641* (2013.01)

(58) Field of Classification Search
CPC .... A61B 50/33; A61B 50/13; A47G 23/0625; A47G 23/0641; A47G 19/065
USPC ..... 206/557, 363, 562; 211/88.01, 128.1, 211/85.13, 86.01
See application file for complete search history.

(56) References Cited

U.S. PATENT DOCUMENTS

2012/0074034 A1* 3/2012 Bar ..... B65D 71/70 206/562
2013/0168275 A1* 7/2013 Hennessey ..... F16M 13/022 248/316.1
2014/0138507 A1* 5/2014 Hennessey ..... F16M 11/14 248/276.1

* cited by examiner

*Primary Examiner* — King M Chu
(74) *Attorney, Agent, or Firm* — Rumit Ranjit Kanakia

(57) ABSTRACT

A modular bowl holder for holding bowls includes at least one top flat plate like structure, a longitudinal supporting base, and a first locking mechanism. The top flat plate like structure includes one or more recesses to hold bowls. The longitudinal supporting base includes a first end portion and a second end portion, opposite to the first end portion. The first end portion includes a tapered orientation. The first locking mechanism is adapted to couple the top flat plate like structure and the longitudinal supporting base along the first end portion such that the top flat plate like structure is taperedly aligned at a predetermined angle. The first locking mechanism may include a first locking member and a second locking member be removably attached to each other to couple the top flat plate like structure to the longitudinal supporting base.

17 Claims, 6 Drawing Sheets

MODULAR BOWL HOLDER

TECHNICAL FIELD

The present invention relates generally to the field of a kind of tableware, and, more particularly, to a bowl holder for transporting and serving articles of food on a serving table.

BACKGROUND

A bowl is a container used to prepare, server, hold or transport food or eatable items contained therein. A holder that holds the bowl is called bowl holder.

In business establishments of serving cooked meals, the meals are often transported and served in hot bowls, as well as consumed from such bowls by customers. Such bowls are typically used in Asian cultures, where dining on extremely (temperature) hot food is common and desired. Protection of personnel and customers from contacting hot surfaces of the bowls and maintaining a meal in a bowl at desired temperatures represent a challenging task.

An arrangement of service dry fruits and/or snacks at platform affixed to the table is not known in the art.

The invention is directed to overcoming one or more of the problems and solving one or more of the needs as set forth above.

SUMMARY OF THE INVENTION

The present invention addresses the above discussed and additional problems by providing a modular arrangement for holding bowls.

In one another aspect, the present disclosure provides a modular bowl holder for holding bowls. The modular bowl holder includes at least one top flat plate like structure, a longitudinal supporting base, and a first locking mechanism. The at least one top flat plate like structure includes one or more recesses to hold bowls. The longitudinal supporting base includes a first end portion and a second end portion, opposite to the first end portion. The first end portion includes a tapered orientation. Further, the first locking mechanism is adapted to couple the at least one top flat plate like structure and the longitudinal supporting base along the first end portion such that the at least one top flat plate like structure is taperedly aligned at a predetermined angle. The first locking mechanism may include a first locking member and a second locking member. The first locking member is coupled to the first end portion of the longitudinal supporting base to be aligned taperedly. Further, the second locking member is coupled to a back side of the at least one top flat plate like structure. The second locking member is removably attached to the first locking member to removably and taperedly couple the at least one top flat plate like structure to the longitudinal supporting base.

In one embodiment, the at least one top flat plate like structure comprises the recesses having at least two substantially identical mirror image recesses spaces disposed away from each other by a pre-determined distance. Each of the at least two substantially identical mirror image recesses forming a cutout with a rim, and the cutout complements a shape of the bowls, including a substantially semi-circular shape, and wherein the cutout removably receive the bowl of a pre-determined diameter into an interior space of the cutout.

In one example arrangement, the at least one top flat plate like structure is of a shape comprises one of a butterfly shape structure or of other different shape structures including one or more recesses to accommodate two or more bowls.

In one example arrangement, each of the at least two substantially identical mirror image recesses are disposed away from each other by means of a cantilever arrangement.

In one example arrangement, the pre-determined diameter of the substantially semi-circular cutout is adapted to receive the bowl in such a manner that a rim of the bowl is configured to be supported along the substantially semi-circular cutout.

In one embodiment of the present disclosure, the longitudinal supporting base locks the at least one top plate like structure using the first locking member and the second locking member of the first locking mechanism, in which: the first locking member comprises top and bottom surfaces, a pair of spaced-prongs, an engaging element, and a pair of engaging slots. The pair of spaced-prongs may extend from the bottom surface to form a channel portion therebetween to engage with the first end portion to couple the first locking member with the longitudinal supporting base. Further, the engaging element may be formed on the top surface, and the pair of engaging slots may be formed along sides of the engaging element extending from the top to bottom surfaces.

Further, in one embodiment, the second locking member may be coupled to the back side of the at least one top flat plate like structure. The second locking member may include a complementary engaging element and a pair of complementary engaging ridges. The complementary engaging element may be detachably and snugly engaged with the engaging element, and the pair of complementary engaging ridges may extend upwardly along sides of the complementary engaging element to detachably and snugly engage with the engaging element.

Furthermore, in one embodiment, the first locking member may include a supporting extension to provide additional support to the at least one top plate like structure is be adjusted, tilted and moveable to the predetermined angles, and the second locking member may include a supporting complementary slot formed between the pair of complementary engaging ridges to accommodate the supporting extension.

In one embodiment, the modular bowl holder may further include a clamping arrangement. The clamping arrangement may be coupled to the second end portion of the longitudinal supporting base to detachably couple the longitudinal supporting base to a platform or a table. In one example, the clamping arrangement includes one-piece C-shaped structure and a tightening screw. The one-piece C-shaped structure may be coupled to the second end portion, and may include a coupling slot configured to be engaged with the platform or to the table. Further, the tightening screw is threadedly coupled to the one-piece C-shaped structure. The tightening screw may be threadedly tightened to adjust a distance of the coupling slot as per thickness of the platform or the table to couple the one-piece C-shaped structure the platform or the table.

In one another embodiment, the modular bowl holder may further include a base member coupled to the second end portion of the longitudinal supporting base to be kept on a platform or a table. The base member may include a groove member to snugly accommodate the second end portion of the longitudinal supporting base to provide support to the modular bowl holder to be kept on the platform or the table.

In yet one another embodiment, the modular bowl holder may further include a base coupling arrangement. The base coupling arrangement may include a base member and a second locking mechanism. In one example arrangement, the second locking mechanism may be similar to the first locking mechanism, wherein the second locking element is removably attached to the first locking element to removably couple the base member to the second end portion.

In one another aspect, the present disclosure provides a modular bowl holder for holding bowls. The modular bowl holder includes at least one top flat plate like structure, a longitudinal supporting base, and a first locking mechanism. The at least one top flat plate like structure includes one or more recesses to hold bowls. The longitudinal supporting base includes a first end portion and a second end portion, opposite to the first end portion. The first end portion includes a tapered orientation. Further, the first locking mechanism is adapted to couple the at least one top flat plate like structure and the longitudinal supporting base along the first end portion such that the at least one top flat plate like structure is taperedly aligned at a predetermined angle. The first locking mechanism may include a first locking member and a second locking member. The first locking member is coupled to the first end portion of the longitudinal supporting base to be aligned taperedly. Further, the second locking member is coupled to a back side of the at least one top flat plate like structure. The second locking member is removably attached to the first locking member to removably and taperedly couple the at least one top flat plate like structure to the longitudinal supporting base.

The first locking member comprises top and bottom surfaces, a pair of spaced-prongs, an engaging element, and a pair of engaging slots. The pair of spaced-prongs may extend from the bottom surface to form a channel portion therebetween to engage with the first end portion to couple the first locking member with the longitudinal supporting base. Further, the engaging element may be formed on the top surface, and the pair of engaging slots may be formed along sides of the engaging element extending from the top to bottom surfaces. Further, the second locking member may be coupled to the back side of the at least one top flat plate like structure. The second locking member may include a complementary engaging element and a pair of complementary engaging ridges. The complementary engaging element may be detachably and snugly engaged with the engaging element, and the pair of complementary engaging ridges may extend upwardly along sides of the complementary engaging element to detachably and snugly engage with the engaging element.

Further, in one embodiment, the first locking member may include a supporting extension to provide additional support to the at least one top plate like structure is be adjusted, tilted and moveable to the predetermined angles, and the second locking member may include a supporting complementary slot formed between the pair of complementary engaging ridges to accommodate the supporting extension.

In yet one another aspect, the present disclosure provides a locking mechanism to couple at least one top flat plate like structure and a longitudinal supporting base of a modular bowl holder. The locking mechanism includes first locking member and a second locking member. The first locking member is coupled to the first end portion of the longitudinal supporting base to be aligned taperedly. Further, the second locking member is coupled to a back side of the at least one top flat plate like structure. The second locking member is removably attached to the first locking member to removably and taperedly couple the at least one top flat plate like structure to the longitudinal supporting base. The first locking member comprises top and bottom surfaces, a pair of spaced-prongs, an engaging element, and a pair of engaging slots. The pair of spaced-prongs may extend from the bottom surface to form a channel portion therebetween to engage with the first end portion to couple the first locking member with the longitudinal supporting base. Further, the engaging element may be formed on the top surface, and the pair of engaging slots may be formed along sides of the engaging element extending from the top to bottom surfaces. Further, the second locking member may be coupled to the back side of the at least one top flat plate like structure. The second locking member may include a complementary engaging element and a pair of complementary engaging ridges. The complementary engaging element may be detachably and snugly engaged with the engaging element, and the pair of complementary engaging ridges may extend upwardly along sides of the complementary engaging element to detachably and snugly engage with the engaging element.

Further, in one embodiment, the first locking member may include a supporting extension to provide additional support to the at least one top plate like structure is be adjusted, tilted and moveable to the predetermined angles, and the second locking member may include a supporting complementary slot formed between the pair of complementary engaging ridges to accommodate the supporting extension.

All objects, features and advantages of the present invention will become apparent in the following detailed written description.

The Summary is neither intended nor should it be construed as being representative of the full extent and scope of the present invention, which these and additional aspects will become more readily apparent from the detailed description, particularly when taken together with the appended drawings.

BRIEF DESCRIPTION OF DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

The diagrams are for illustration only, which thus is not a limitation of the present disclosure, and wherein.

DETAILED DESCRIPTION OF DRAWINGS

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure.

In the following description, numerous specific details are set forth in order to provide a thorough understanding of embodiments of the present invention. It may be apparent to one skilled in the art that embodiments of the present invention may be practiced without some of these specific details.

Various terms as used herein are shown below. To the extent a term used, it should be given the broadest definition persons in the pertinent art have given that term as reflected in printed publications and issued patents at the time of filing.

Figure 1A:
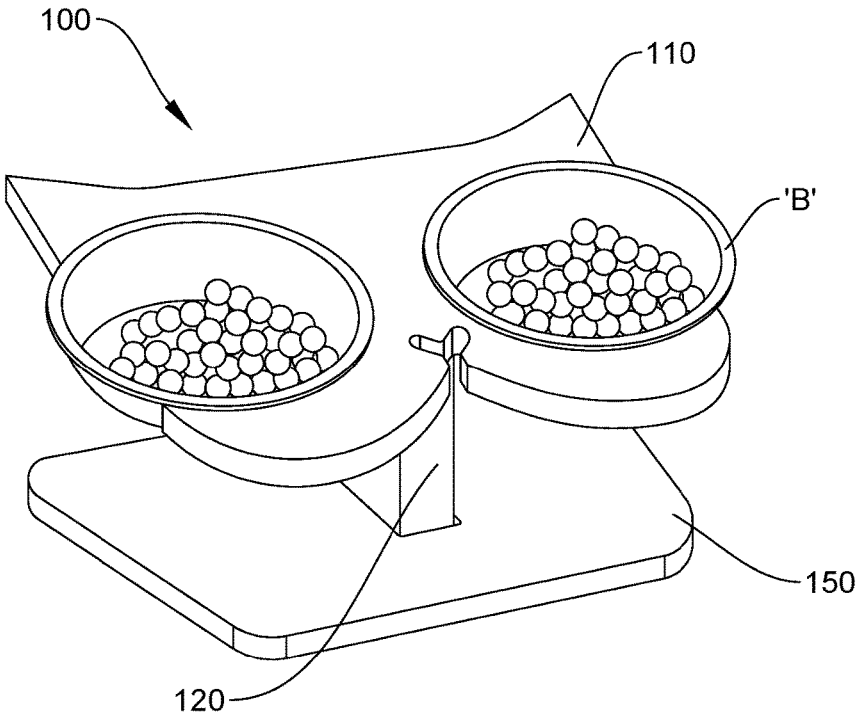
FIGS. 1A and 1B, respectively, illustrate an assembled modular bowl holder and an unassembled modular bowl holder, according to one embodiment suitable for practicing the invention.
Figure 1B:
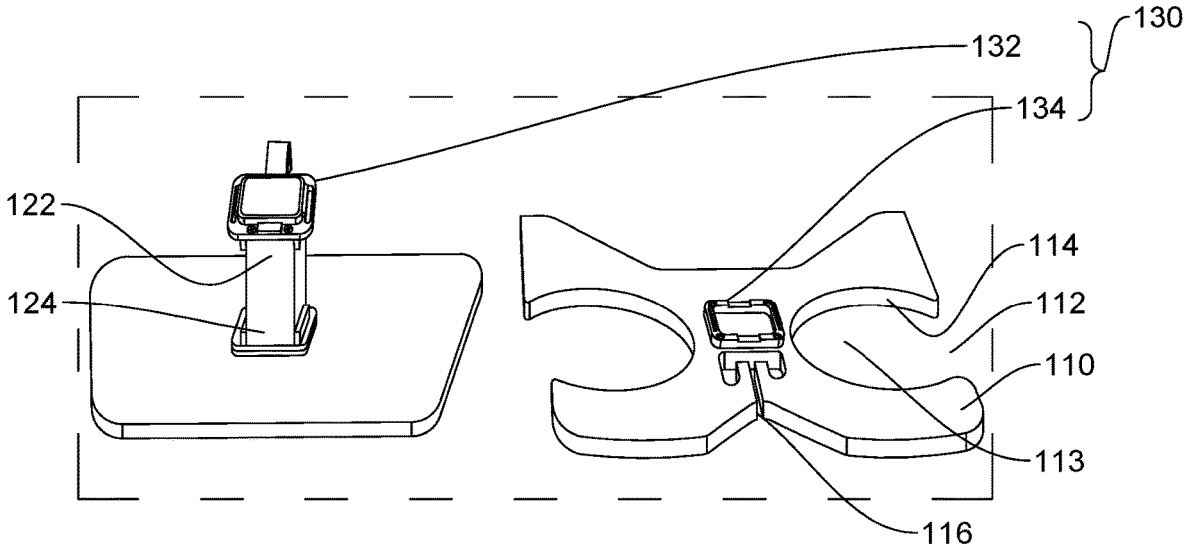

As shown in FIGS. 1A and 1B, a modular bowl holder 100 for holding bowls 13' is provided. The modular bowl holder 100 includes at least one top flat plate like structure 110, a longitudinal supporting base 120, and a first locking mechanism 130. The top flat plate like structure 110 includes one or more recesses 112 to hold bowls. The longitudinal supporting base 120 includes a first end portion 122 and a second end portion 124, opposite to the first end portion 122. The first end portion 122 includes a tapered orientation. Further, the first locking mechanism 130 is adapted to couple the top flat plate like structure 110 and the longitudinal supporting base 120 along the first end portion 122 such that the top flat plate like structure 110 is taperedly aligned at a predetermined angle. The first locking mechanism 130 may include a first locking member 132 and a second locking member 134. The first locking member 132 is coupled to the first end portion 122 of the longitudinal supporting base 120 to be aligned taperedly. Further, the second locking member 134 is coupled to a back side of the top flat plate like structure 110. The second locking member 134 is removably attached to the first locking member 132 to removably and taperedly couple the top flat plate like structure 110 to the longitudinal supporting base 120.

In one embodiment, as seen in FIG. 1B, the top flat plate like structure 110 comprises the recesses having at least two substantially identical mirror image recesses 112 spaces disposed away from each other by a pre-determined distance. Each of the at least two substantially identical mirror image recesses 112 forming a cutout 113 with a rim 114. The cutout 113 complements a shape of the bowl 13', which may include a substantially semi-circular shape, and the cutout 113 may removably receive the bowl 13' of a pre-determined diameter into an interior space of the cutout 113.

In one example arrangement, the top flat plate like structure 110 is of a shape comprises one of a butterfly shape structure or of other different shape structures including one or more recesses to accommodate two or more bowls.

In one further example arrangement, as seen in FIG. 1B, each of the at least two substantially identical mirror image recesses 112 are disposed away from each other by means of a cantilever arrangement 116.

In one example arrangement, as seen in FIG. 1A, the pre-determined diameter of the substantially semi-circular cutout 113 is adapted to receive the bowl 13' in such a manner that a rim 'r' of the bowl 13' is configured to be supported along the substantially semi-circular cutout 112.

Figure 2A:
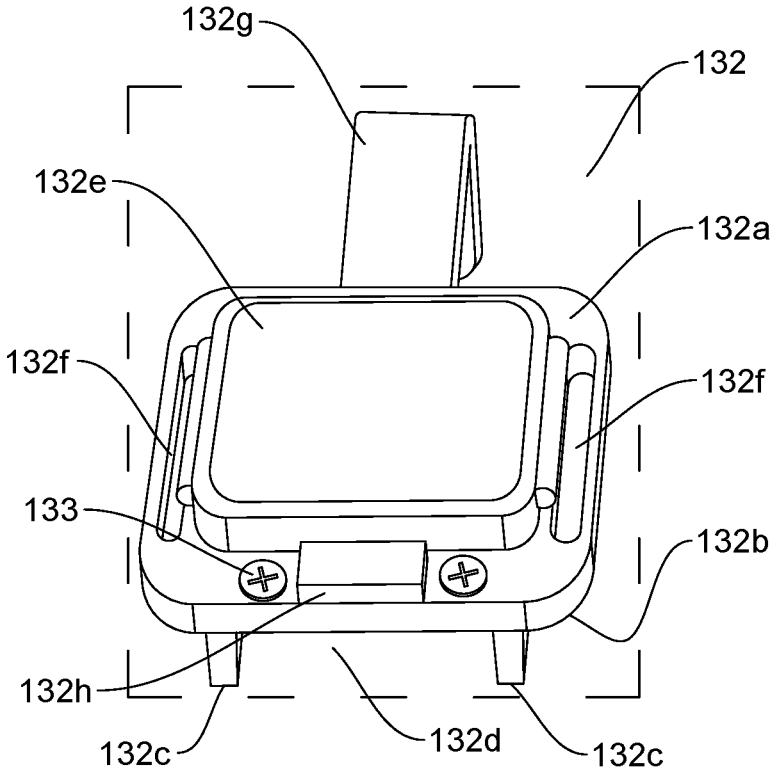
FIGS. 2A and 2B illustrate a first locking mechanism having a first locking member (FIG. 2A) and a second locking member (FIG. 2B) of the modular bowl holder, according to one embodiment suitable for practicing the invention.
Figure 2B:
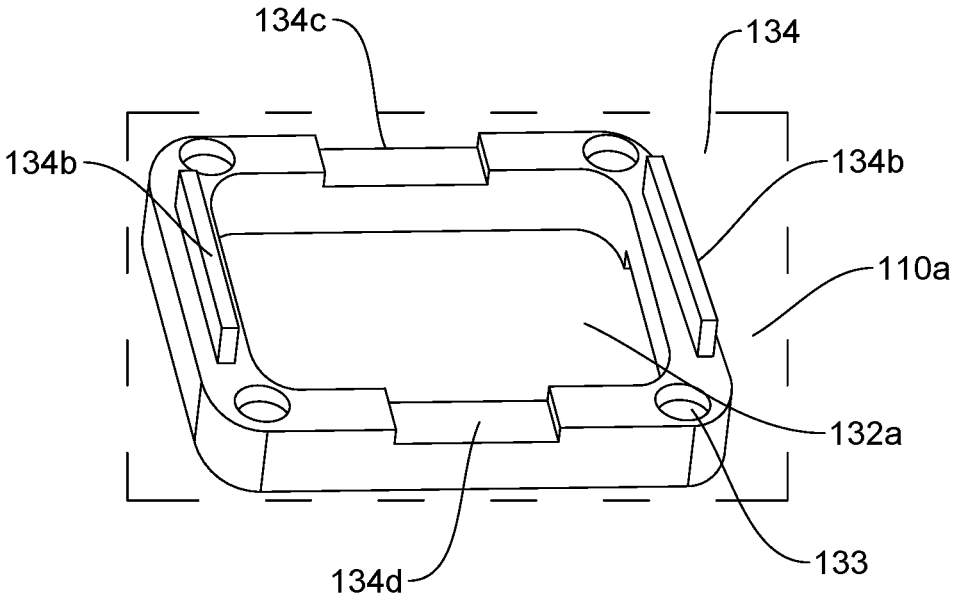

Referring now to FIGS. 2A and 2B, in one embodiment of the present disclosure, the first locking mechanism 130 is shown. Using the first locking mechanism 130, the top plate like structure 110 is locked on the longitudinal supporting base 120. As shown, in one example arrangement, the first locking member 132 includes top and bottom surfaces 132*a*, 132*b*, a pair of spaced-prongs 132*c*, an engaging element 132*e*, and a pair of engaging slots 132*f* The pair of spaced-prongs 132*c* may extend from the bottom surface 132*a* to form a channel portion 132*d* therebetween to engage with the first end portion 122 to couple the first locking member 132 with the longitudinal supporting base 120. Further, the engaging element 132*e* may formed on the top surface 132*a*, and the pair of engaging slots 132*f* may be formed along sides of the engaging element 132*e* extending from the top to bottom surfaces 132*a*, 132*b*.

Further, as shown in FIG. 2B, in one embodiment, the second locking member 134 may be coupled to the back side 110*a* of the top flat plate like structure 110. The second locking member 134 may include a complementary engaging element 132*a* and a pair of complementary engaging ridges 132*b*. The complementary engaging element 132*a* may be detachably and snugly engage with the engaging element 132*e*, and the pair of complementary engaging ridges 132*b* may extend upwardly along sides of the complementary engaging element 132*a* to detachably and snugly engage with the engaging element 132*e*.

Furthermore, in one embodiment, as shown in FIGS. 2A and 2B, the first locking member 132 may include a supporting extension 132*g* to provide additional support to the top plate like structure 110 that may be adjusted, tilted and moveable to the predetermined angles. Further, the second locking member 134 may include a supporting complementary slot 134*c* formed between the pair of complementary engaging ridges 132*b* to accommodate the supporting extension 134*g*.

Moreover, a combination of additional support members 132*h* and 134*d* are respectively provided on the first locking member 134 and the second locking member 134 to be engaged with each other to provide additional griping support to coupling of the first locking member 134 and the second locking member 134. In one example arrangement, the additional support member 132*h* may be a recess, and the additional support member 134*d* may be a complementary slot that accommodates the recess.

As shown in FIGS. 2A and 2B, the first locking member 134 and the second locking member 134 may be coupled to the respective the longitudinal supporting base 120 and the top flat plate like structure 110 using suitable coupling means, such as screws 133. However, without departing from the scope of the present disclosure, the first locking member 134 and the second locking member 134 may be coupled to the respective the longitudinal supporting base 120 and the top flat plate like structure 110 using any other suitable coupling means.

Figure 3:
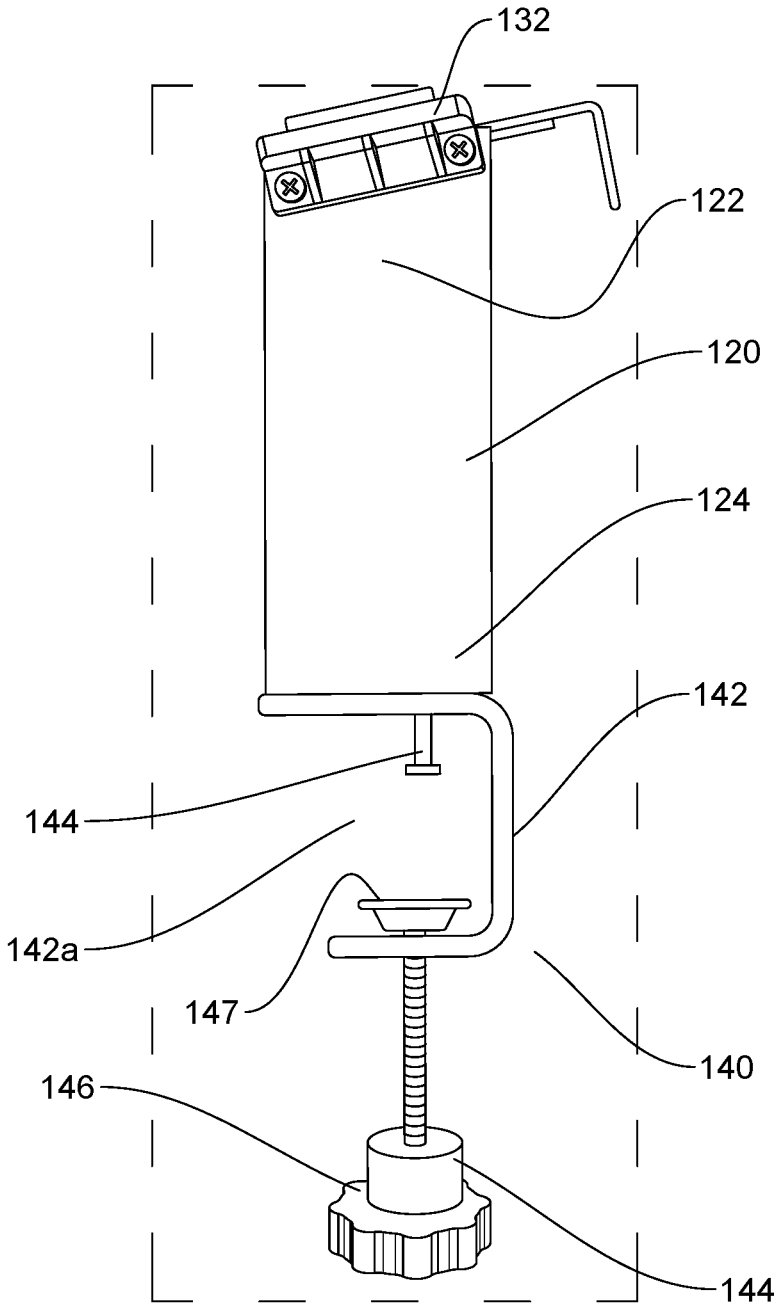
FIG. 3 illustrates a longitudinal supporting base of a modular bowl holder having a clamping arrangement, according to one embodiment suitable for practicing the invention.

Referring now to FIG. 3, in one embodiment, the modular bowl holder 100 may further include a clamping arrangement 140. The clamping arrangement 140 may be coupled to the second end portion 124 of the longitudinal supporting base 120 to detachably couple the longitudinal supporting base 120 to a platform or a table. In one example, the clamping arrangement 140 may be coupled to the second end portion 124 of the longitudinal supporting base 120 by screws 144. In one example arrangement, the clamping arrangement 140 includes one-piece C-shaped structure 142 and a tightening screw 144. The one-piece C-shaped structure 142 may be coupled to the second end portion 124, and may include a coupling slot 142*a* configured to be engaged with the platform or to the table. Further, the tightening screw 144 is threadedly coupled to the one-piece C-shaped structure 142. The tightening screw 144 may be threaded and include a knob 146 at one end and a flange 147 at another end thereof. The tightening screw 144 may be threadedly tightened via the knob 146 to adjust a distance of the coupling slot 142*a* as per thickness of the platform or the table to couple the one-piece C-shaped structure 142 with the help the flange 147 to the platform or the table.

Figure 4:
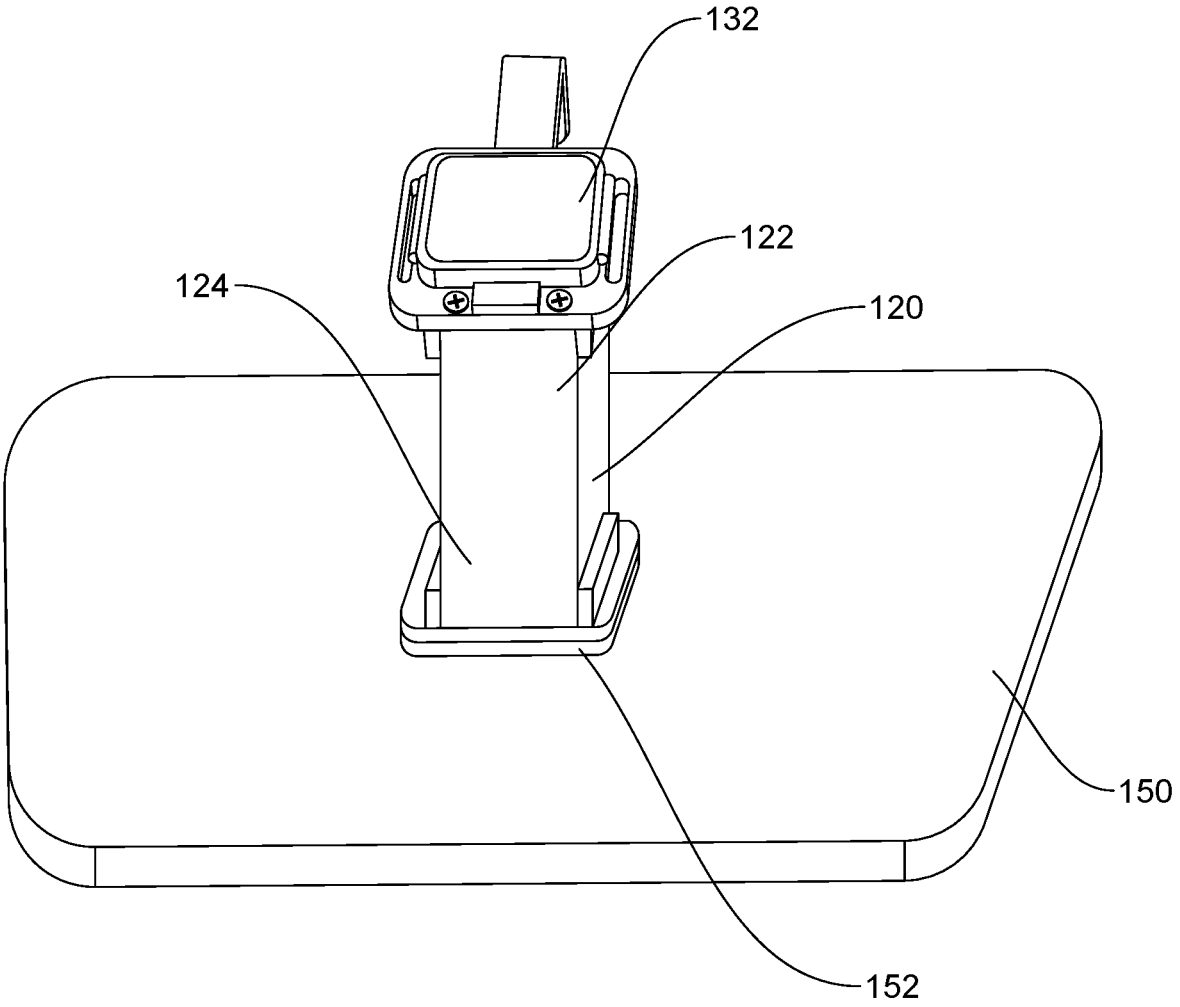
FIG. 4 illustrates a longitudinal supporting base of a modular bowl holder coupled to a base member, according to one another embodiment suitable for practicing the invention.

Referring now to FIG. 4, in one another embodiment, the modular bowl holder 100 may further include a base member 150 coupled to the second end portion 124 of the longitudinal supporting base 120 to be kept on a platform or a table. The base member 150 may include a groove member 152 to snugly accommodate the second end portion 124 of the longitudinal supporting base 120 to provide support to the modular bowl holder to be kept on the platform or the table.

Figure 5:
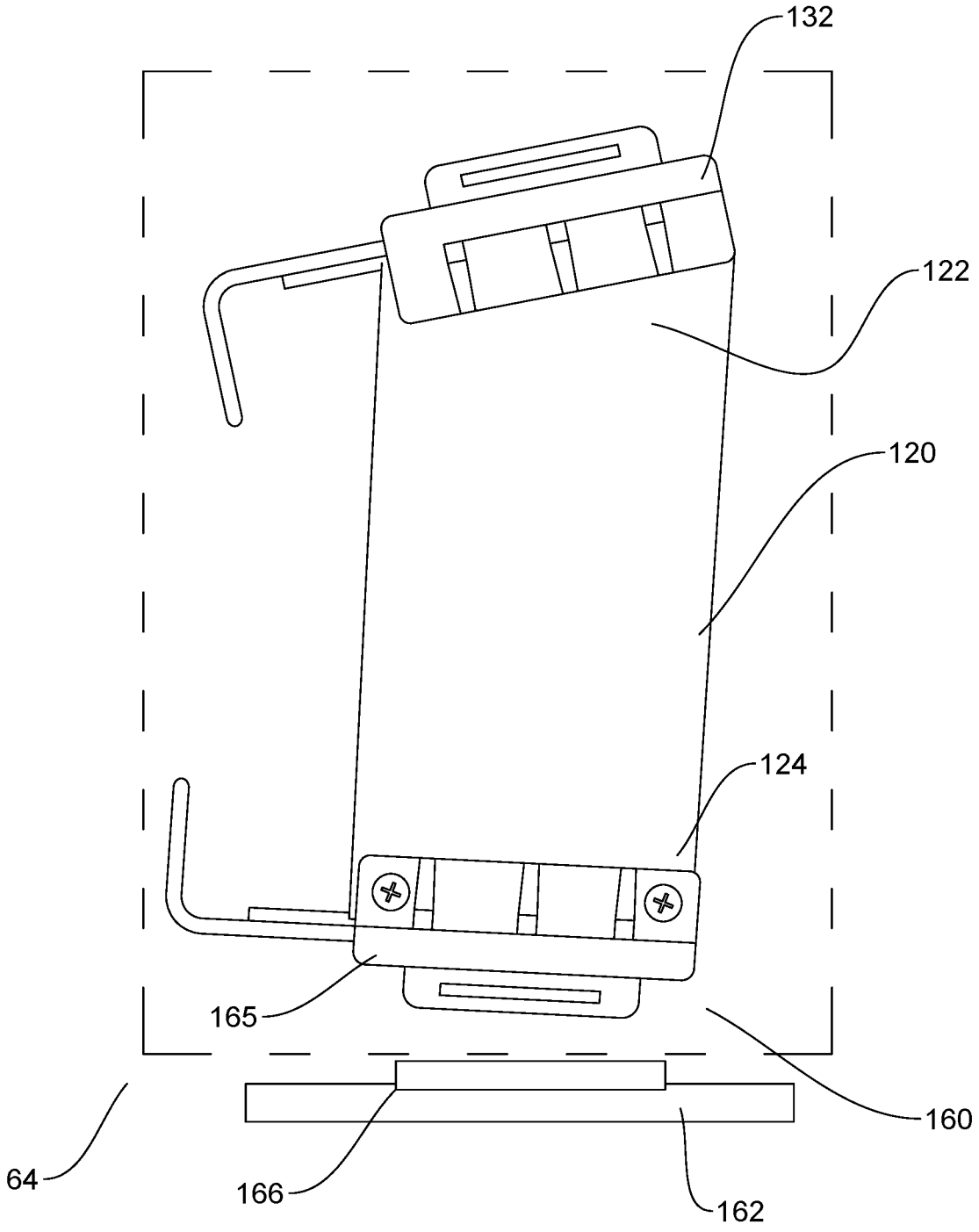
FIG. 5 illustrates a longitudinal supporting base of a modular bowl holder coupled to a base coupling arrangement, according to one another embodiment suitable for practicing the invention.

Referring now to FIG. 5, in yet one another embodiment, the modular bowl holder 100 may further include a base coupling arrangement 160. The base coupling arrangement 160 may include a base member 162 and a second locking mechanism 164. In one example arrangement, the second locking mechanism 164 may be similar to the first locking mechanism 130, wherein the second locking element 166 is removably attached to the first locking element 165 to removably couple the base member 162 to the second end portion 124, and not described herein for the sake of brevity.

Embodiments as depicted and described in conjunction with FIGS. 4 and 6 are suitable for having the modular bowl holder 100 movable from one place to another place over the table or the platform.

Figure 6A:
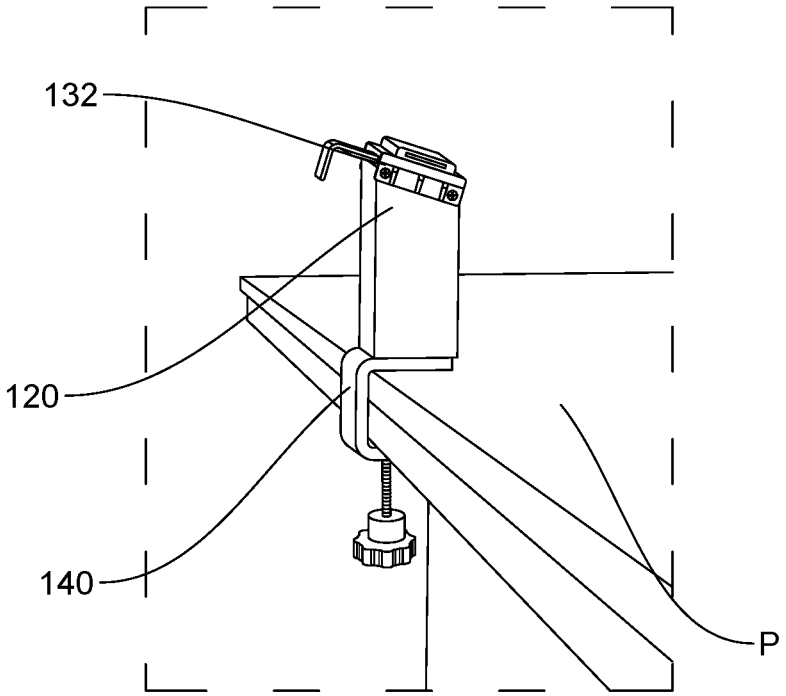
FIGS. 6A and 6B illustrate fixed clamping of the bowl holder over the supporting base or a platform.
Figure 6B:
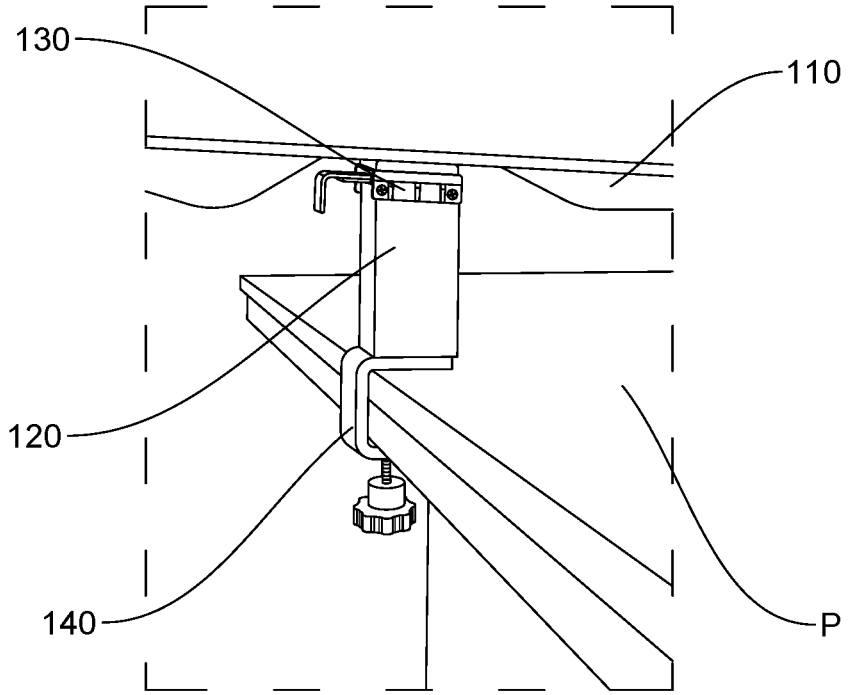

Further, the embodiments as depicted and described in conjunction with FIG. 3 is suitable for having the modular bowl holder 100 fixed to the table or to the platform 'T'. As seen in FIGS. 6A and 6B, the clamping arrangement 140 is coupled to an edge of the platform or the table (FIG. 6A). Further, as seen in FIG. 6B, the top flat plate like structure 110 is coupled to the longitudinal supporting base 120, thereby fixedly coupling the modular bowl holder 100 fixed to the table or to the platform.

Although the present invention herein has been described with reference to particular preferred embodiments thereof, it is to be understood that these embodiments are merely illustrative of the principles and applications of the invention. Therefore, modifications may be made to these embodiments and other arrangements may be devised without departing from the spirit and scope of the invention, which is defined by the appended claims.

What is claimed is:

1. A modular bowl holder for holding bowls, the modular bowl holder comprising:

at least one top planar structure having one or more recesses to hold bowls;

a longitudinal supporting base having a first end portion and a second end portion, opposite to the first end portion, wherein the first end portion includes a tapered surface;

a first locking mechanism to couple the at least one top planar structure and the longitudinal supporting base along the first end portion such that the at least one top planar structure is aligned along the tapered surface at a predetermined angle, wherein the first locking mechanism comprises:

a first locking member coupled to the first end portion of the longitudinal supporting base to be aligned along the tapered surface, a second locking member coupled to a back side of the at least one top planar structure, wherein the second locking member is removably attached to the first locking member to removably couple the at least one top planar structure to the longitudinal supporting base along the tapered surface, wherein the at least one top planar structure comprises, the recesses having at least two substantially identical mirror image recesses spaces disposed away from each other by a pre-determined-distance, wherein each of the at least two substantially identical mirror image recesses forming a cutout with a rim, the cutout complements a shape of the bowls, including a substantially semi-circular shape, and wherein the cutout removably receive the bowl of a pre-determined diameter into an interior space of the cutout.

2. The modular bowl holder of claim 1, wherein the at least one top planar structure is of a shape comprises one of a butterfly shape structure or of other different shape structures including one or more recesses to accommodate two or more bowls.

3. The modular bowl holder of claim 1, wherein each of the at least two substantially identical mirror image recesses are disposed away from each other by means of a cantilever arrangement.

4. The modular bowl holder of claim 1, wherein the pre-determined diameter of the cutout is adapted to receive the bowl in such a manner that a rim of the bowl is configured to be supported along the cutout.

5. The modular bowl holder of claim 1, wherein the longitudinal supporting base locks the at least one top plate like structure using the first locking member and the second locking member of the first locking mechanism, in which:

the first locking member comprises, top and bottom surfaces, a pair of spaced-prongs extending from the bottom surface to form a channel portion therebetween to engage with the first end portion to couple the first locking member with the longitudinal supporting base, an engaging element formed on the top surface, and a pair of engaging slots formed along sides of the engaging element extending from the top to bottom surfaces.

6. The modular bowl holder of claim 2, wherein the longitudinal supporting base locks the at least one top plate like structure using the first locking member and the second locking member of the first locking mechanism, in which:

the second locking member is coupled to the back side of the at least one top planar structure, and the second locking member comprises:

an engaging element to detachably and snugly engage with the engaging element, and a pair of engaging ridges extending upwardly along sides of the engaging element to detachably and snugly engage with the engaging element.

7. The modular bowl holder of claim 3, wherein:

the first locking member comprises a supporting extension to provide additional support to the at least one top plate like structure is be adjusted, tilted and moveable to the predetermined angles, and the second locking member comprises a supporting slot formed between the pair of engaging ridges to accommodate the supporting extension.

8. The modular bowl holder of claim 1 further comprising:

a clamping arrangement coupled to the second end portion of the longitudinal supporting base to detachably couple the longitudinal supporting base to a platform or a table, wherein the clamping arrangement comprises:

one-piece C-shaped structure coupled to the second end portion, the one-piece C-shaped structure having a coupling slot configured to be engaged with the platform or to the table; and a tightening screw threadedly coupled to the one-piece C-shaped structure, wherein the tightening screw is threadedly tightened to adjust a distance of the coupling slot as per thickness of the platform or the table to couple the one-piece C-shaped structure the platform or the table.

9. The modular bowl holder of claim 1 further comprising:

a base member coupled to the second end portion of the longitudinal supporting base to be kept on a platform or a table, wherein the base member comprises a groove member to snugly accommodate the second end portion of the longitudinal supporting base to provide support to the modular bowl holder to be kept on the platform or the table.

10. The modular bowl holder of claim 1 further comprising a base coupling arrangement, wherein the base coupling arrangement comprises:

a base member; and a second locking mechanism, wherein the second locking element is removably attached to the first locking element to removably couple the base member to the second end portion.

11. A modular bowl holder for holding bowls, the modular bowl holder comprising:

at least one top planar structure having one or more recesses to hold bowls;

a longitudinal supporting base having a first end portion and a second end portion, opposite to the first end portion, wherein the first end portion includes a tapered surface;

a first locking mechanism to couple the at least one top planar structure and the longitudinal supporting base along the first end portion such that the at least one top planar structure is aligned along the tapered surface at a predetermined angle, wherein the first locking mechanism comprises:

a first locking member coupled to the first end portion of the longitudinal supporting base to be aligned along the tapered surface, a second locking member coupled to a back side of the at least one top planar structure, wherein the second locking member is removably attached to the first locking member to removably couple the at least one top planar structure to the longitudinal supporting base along the tapered surface, and wherein the longitudinal supporting base locks the at least one top plate like structure using the first locking member and the second locking member of the first locking mechanism, in which:

the first locking member comprises, top and bottom surfaces, a pair of spaced-prongs extending from the bottom surface to form a channel portion therebetween to engage with the first end portion to couple the first locking member with the longitudinal supporting base, an engaging element formed on the top surface, and a pair of engaging slots formed along sides of the engaging element extending from the top to bottom surfaces;

the second locking member is coupled to the back side of the at least one top planar structure, and the second locking member comprises:

an engaging element to detachably and snugly engage with the engaging element, and a pair of engaging ridges extending upwardly along sides of the engaging element to detachably and snugly engage with the engaging element.

12. The modular bowl holder of claim 11, wherein:

the first locking member comprises a supporting extension to provide additional support to the at least one top plate like structure is be adjusted, tilted and moveable to the predetermined angles, and the second locking member comprises a supporting slot formed between the pair of engaging ridges to accommodate the supporting extension.

13. The modular bowl holder of claim 11 further comprising:

a clamping arrangement coupled to the second end portion of the longitudinal supporting base to detachably couple the longitudinal supporting base to a platform or a table, wherein the clamping arrangement comprises:

one-piece C-shaped structure coupled to the second end portion, the one-piece C-shaped structure having a coupling slot configured to be engaged with the platform or to the table; and a tightening screw threadedly coupled to the one-piece C-shaped structure, wherein the tightening screw is threadedly tightened to adjust a distance of the coupling slot as per thickness of the platform or the table to couple the one-piece C-shaped structure the platform or the table.

14. The modular bowl holder of claim 11 further comprising:

a base member coupled to the second end portion of the longitudinal supporting base to be kept on a platform or a table, wherein the base member comprises a groove member to snugly accommodate the second end portion of the longitudinal supporting base to provide support to the modular bowl holder to be kept on the platform or the table.

15. The modular bowl holder of claim 11 further comprising a base coupling arrangement, wherein the base coupling arrangement comprises:

a base member; and a second locking mechanism, wherein the second locking element is removably attached to the first locking element to removably couple the base member to the second end portion.

16. A locking mechanism to couple at least one top planar structure and a longitudinal supporting base of a modular bowl holder, the locking mechanism comprising:

a first locking member coupled to a first end portion of the longitudinal supporting base to be aligned along a tapered surface at the first end portion, a second locking member coupled to a back side of the at least one top planar structure, wherein the second locking member is removably attached to the first locking member to removably couple the at least one top planar structure to the longitudinal supporting base along the tapered surface, wherein the first locking member comprises, top and bottom surfaces, a pair of spaced-prongs extending from the bottom surface to form a channel portion therebetween to engage with the first end portion to couple the first locking member with the longitudinal supporting base, an engaging element formed on the top surface, and a pair of engaging slots formed along sides of the engaging element extending from the top to bottom surfaces;

wherein the second locking member is coupled to the back side of the at least one top planar structure, and the second locking member comprises:

an engaging element to detachably and snugly engage with the engaging element, and a pair of engaging ridges extending upwardly along sides of the engaging element to detachably and snugly engage with the engaging element.

17. The locking mechanism of claim 16, wherein:

the first locking member comprises a supporting extension to provide additional support to the at least one top plate like structure is be adjusted, tilted and moveable to the predetermined angles, and the second locking member comprises a supporting slot formed between the pair of engaging ridges to accommodate the supporting extension.

* * * * *